United States Patent [19]

Bell

[11] 4,001,934

[45] Jan. 11, 1977

[54] COIN ROLL CUTTER

[76] Inventor: Robert G. Bell, 300 Rolling Oaks Drive, Apt. 167, Thousand Oaks, Calif. 91360

[22] Filed: July 10, 1975

[21] Appl. No.: 594,866

[52] U.S. Cl. ..... 30/124; 30/90.4; 30/92.5

[51] Int. Cl.[2] ..... B25F 3/00; B26B 3/00

[58] Field of Search ..... 30/92.5, 90.4, 90.6, 30/90.7, 124

[56] References Cited

UNITED STATES PATENTS

| | | | |
|---|---|---|---|
| 1,739,972 | 12/1929 | Klinger | 30/90.4 |
| 2,220,631 | 11/1940 | Yagel | 30/90.4 |
| 2,234,013 | 3/1941 | Stover | 30/90.4 X |
| 2,468,122 | 4/1949 | Shepard | 30/90.6 |
| 2,621,659 | 12/1952 | Greene | 30/90.4 X |
| 2,776,480 | 1/1957 | Abel | 30/124 |
| 3,092,906 | 6/1963 | Deering | 30/90.6 |
| 3,238,618 | 3/1966 | Cook | 30/90.4 |
| 3,579,825 | 5/1971 | Powell | 30/90.7 |
| 3,898,733 | 8/1975 | Cormier | 30/90.4 |

*Primary Examiner*—Al Lawrence Smith
*Assistant Examiner*—J. T. Zatarga
*Attorney, Agent, or Firm*—Jack C. Munro

[57] ABSTRACT

A cutter for coin rolls wherein the cutter includes a bifurcated section divided into a first leg and a second leg with a receiving chamber being located therebetween, said first leg and said second leg being deflectable away from each other so as to permit different diameters of coin rolls to be accommodated within said receiving chamber.

4 Claims, 5 Drawing Figures

COIN ROLL CUTTER

BACKGROUND OF THE INVENTION

The field of this invention relates to cutting devices and more particularly to a cutting device that is to be specifically employed to cut the paper roll from a tightly-packed roll of coins.

It has been an extremely common practice in the past for banks to disperse coins in the form of rolls wherein a fixed dollar quantity of coins are placed within a paper roll. For example, the typical paper roll for quarters would contain forty quarters which would have a ten dollar value.

At the present time, the rolling of these coins is accomplished with the aid of automatic machinery. The result is that the coins are quite tightly packed and the paper roll is extremely tight around the periphery of the roll of coins. The normal procedure for the person dispersing the coins (such as a grocery store cashier) is for the cashier to merely strike the roll against a sharp edge (like the end of a table) or to merely tear the paper roll from the coins. However, since the paper rolls are now tightly packed due to the automating of the rolling of the coins, the paper rolls are difficult to break when the coin roll is struck against a sharp edge and it is also very difficult to tear the paper rolls by a person's hand.

Therefore, there is a definite need to employ the use of a cutting device that can be operated in a simple manner to effect removal of the paper roll from a roll of coins in order to gain access to the coins.

SUMMARY OF THE INVENTION

The subject matter of this invention is believed to be summarily described in the Abstract Of The Disclosure and reference is to be had thereto.

The primary advantage of the cutter of this invention is that it is of simple construction and can be easily employed. A further advantage is that the cutter of this invention is of a quite small size so that it can be readily carried on the person and even when carried on the person there is no fear of the blade of the cutter causing damage to the person's clothes or injury to the person himself. A further advantage of this invention is that the cutter can accommodate various diameter of coin rolls and can be readily employed for a penny roll, a nickel roll, a dime roll, and a quarter roll. A further advantage of this invention is that the device is constructed of a readily available inexpensive material.

DETAILED DESCRIPTION OF THE SHOWN EMBODIMENT

Figure 1:
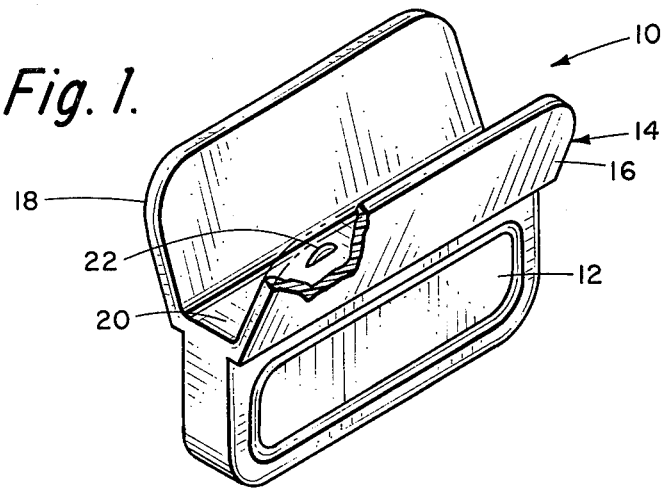
FIG. 1 is an isometric view of the cutter of this invention.

Referring particularly to the drawing, there is shown in FIG. 1 the cutter 10 of this invention which is composed basically of a base 12 and a bifurcated section 14 which is composed generally of a first leg 16 and a second leg 18. The first leg 16 and the second leg 18 are integrally connected to the base 12 and are actually positioned in an inclined manner with respect to the base 12. Between the inclined legs 16 and 18 is a coin roll receiving chamber 20.

It is contemplated that the entire cutter of this invention which is formed of base 12 and the bifurcated section 14 is to be constructed of a plastic material which includes a certain amount of resiliency so that to facilitate deflecting movement of the legs 16 and 18 with respect to the base 12. A typical example of a type of plastic would be polyethylene plastic.

Fixedly mounted within the base 12 and extending slightly within the coin roll receiving chamber 20 is a metallic knife blade 22. The knife blade 22 can assume any configuration and will normally just be embedded within the base 12. The blade 22 just extends a slight distance into the coin receiving chamber 20.

Figure 4:
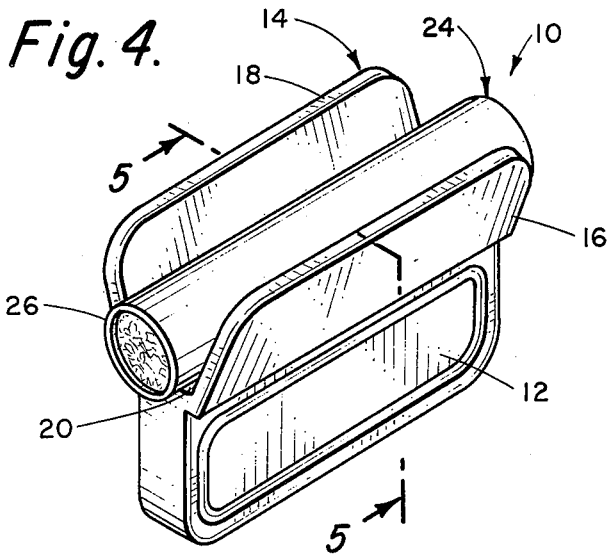
FIG. 4 is a view similar to FIG. 2 but showing the cooperation of the cutter of this invention with the smaller diametered coin roll.
Figure 5:
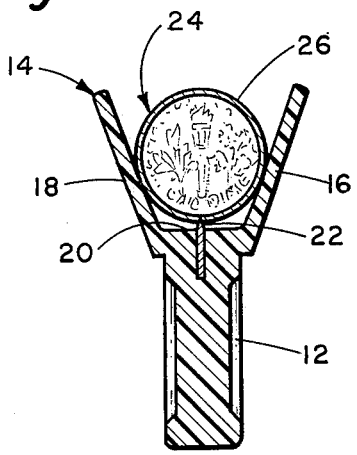
FIG. 5 is a cross-sectional view taken along line 5—5 of FIG. 4.

In operation of this invention, a person may grasp a coin roll 24 and place such within the coin receiving chamber 20. If the coin roll 24 is a smaller diametered coin roll, such as the roll of dimes shown in FIGS. 4 and 5, the exterior of the roll 24 comprising the paper roll 26 will merely come to rest against the knife blade 22. The person then merely longitudinally moves the cutter 10 against the roll 24 until the paper roll 26 is severed a sufficient amount. The coin roll 24 is then removed from the cutter and since the paper has been severed, the person can readily obtain access to the coins. The severed paper roll is then discarded.

Figure 2:
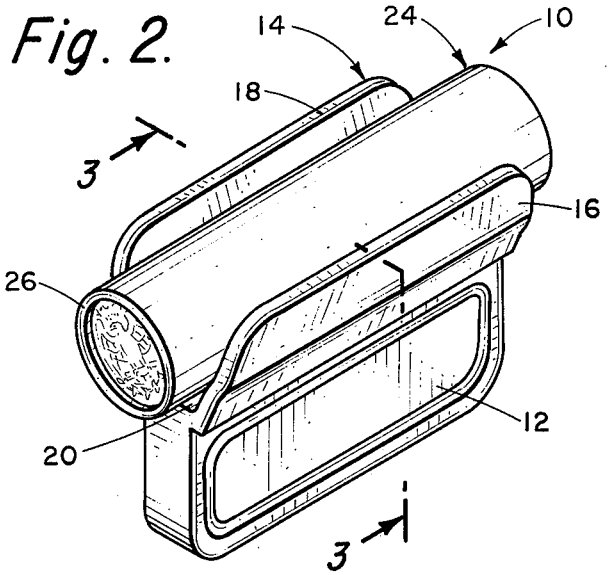
FIG. 2 is a view similar to FIG. 1 but showing the cooperation of the cutter with a coin roll.
Figure 3:
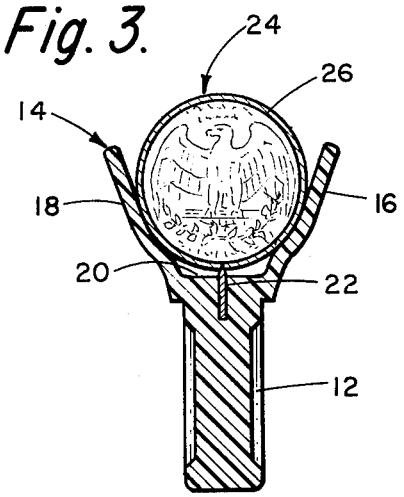
FIG. 3 is a cross-sectional view taken along line 3—3 of FIG. 2.

When a larger diametered roll of coins is employed, such as shown in FIGS. 2 and 3, the mere placing of the coin roll 24 within the coin receiving chamber 20, the paper roll 26 does not contact the knife blade 22. It is then required that the person push the cutter 10 against the coin roll 24 until the knife blade 22 comes in contact with the paper roll 26. The legs 16 and 18 merely deflect outwardly away from each other in order to accommodate this larger sized roll of coins. The operator then merely moves longitudinally the cutter 10 along the roll of coins until the paper roll 26 is severed.

What is claimed is:

1. A cutter for coin rolls comprising:

a base, said base being adapted to be grasped by a person's hand;

a bifurcated section divided into a first leg and a second leg, a receiving chamber located between said legs;

a knife blade connected to said base and extending within said receiving chamber, said blade adapted to contact the paper roll of a coin roll that is placed within said receiving chamber and as said cutter is moved longitudinally along the coin roll the paper roll is severed, said first leg and said second leg being formed of a material of construction so as to permit automatic deflection of said legs in respect to said base to accomodate different sizes of coin rolls by said legs spreading apart when a larger diametered coin roll is inserted within said receiving chamber and upon removal of the coin roll the legs automatically return to the undeflected state.

2. The cutter as defined in claim 1 wherein:

said blade fixedly mounted within said base.

3. The cutter as defined in claim 2 wherein:

said bifurcated section being formed integral to said base.

4. The cutter as defined in claim 3 wherein:

said bifurcated section being formed of a slightly deflectable plastic material.

* * * * *